US010819054B2

(12) United States Patent
Terajima et al.

(10) Patent No.: US 10,819,054 B2
(45) Date of Patent: Oct. 27, 2020

(54) ELECTRICAL TERMINAL OF A THERMOCOUPLE

(71) Applicant: Tyco Electronics Japan G.K., Kanagawa (JP)

(72) Inventors: Keita Terajima, Kanagawa (JP); Masaaki Harasawa, Kanagawa (JP)

(73) Assignee: Tyco Electronics Japan G.K., Kawasaki-shi (JP)

( * ) Notice: Subject to any disclaimer, the term of this patent is extended or adjusted under 35 U.S.C. 154(b) by 0 days.

(21) Appl. No.: 15/225,896

(22) Filed: Aug. 2, 2016

(65) Prior Publication Data

US 2017/0040726 A1 Feb. 9, 2017

(30) Foreign Application Priority Data

Aug. 4, 2015 (JP) ..... 2015-154092

(51) Int. Cl.

| | |
|---|---|
| ***H01R 4/26*** | (2006.01) |
| ***H01R 4/20*** | (2006.01) |
| ***H01R 24/40*** | (2011.01) |
| ***H01R 13/03*** | (2006.01) |
| ***H01R 4/62*** | (2006.01) |
| ***H01R 4/48*** | (2006.01) |
| ***H01R 4/18*** | (2006.01) |

(Continued)

(52) U.S. Cl.

CPC ..... *H01R 13/03* (2013.01); *H01R 4/023* (2013.01); *H01R 4/184* (2013.01); *H01R 4/185* (2013.01); *H01R 4/4809* (2013.01); *H01R 4/62* (2013.01); *H01R 13/052* (2013.01); *H01R 13/055* (2013.01); *H01R 13/113* (2013.01); *H01R 13/17* (2013.01); *H01R 13/20* (2013.01); *H01R 43/04* (2013.01); *H01R 43/26* (2013.01); *H01R 2101/00* (2013.01)

(58) Field of Classification Search

CPC .... H01R 23/02; H01R 24/60; H01R 13/6275; H01R 13/6582; H01R 13/658; H01R 13/6585

USPC ..... 439/877, 879, 585, 442, 852, 891, 752.5

See application file for complete search history.

(56) References Cited

U.S. PATENT DOCUMENTS 5,781,692 A * 7/1998 Wagner ..... H05B 3/0038 118/724
6,290,556 B1 * 9/2001 Howland ..... H01R 4/188 439/879

(Continued)

FOREIGN PATENT DOCUMENTS

DE 102005053566 A1 5/2007
JP 53-37085 4/1978

(Continued)

OTHER PUBLICATIONS

Abstract of JPH0996570, dated Apr. 8, 1997, 1 page.

(Continued)

*Primary Examiner* — Abdullah A Riyami
*Assistant Examiner* — Thang H Nguyen
(74) *Attorney, Agent, or Firm* — Barley Snyder

(57) ABSTRACT

An electrical terminal is disclosed. The electrical terminal has a contact made of a first kind of metal and a coupling member made of a second kind of metal fixed to the contact. The coupling member has a crimping portion crimped to press the first contact against an electrical wire made of the first kind of metal.

22 Claims, 7 Drawing Sheets

(51) Int. Cl.

| | |
|---|---|
| ***H01R 13/11*** | (2006.01) |
| ***H01R 4/02*** | (2006.01) |
| ***H01R 13/05*** | (2006.01) |
| ***H01R 13/17*** | (2006.01) |
| ***H01R 13/20*** | (2006.01) |
| ***H01R 43/04*** | (2006.01) |
| ***H01R 43/26*** | (2006.01) |
| *H01R 101/00* | (2006.01) |

(56) References Cited

U.S. PATENT DOCUMENTS 7,114,986 B1 * 10/2006 Toly ..... H01R 4/4836 439/441
7,371,132 B2 * 5/2008 Tanaka ..... H01R 13/113 439/752.5
7,530,859 B2 * 5/2009 Moll ..... H01R 4/185 439/852
7,556,541 B2 * 7/2009 Tyler ..... H01R 13/03 439/843
7,766,707 B2 * 8/2010 Vista, Jr. ..... H01R 13/04 439/166
7,918,695 B2 * 4/2011 Kutsuna ..... H01R 13/187 439/845
7,950,972 B1 5/2011 Chen et al.
7,976,353 B2 * 7/2011 Myer ..... H01R 13/04 439/891
8,684,769 B2 * 4/2014 Kao ..... H01R 13/6471 439/607.28
8,968,031 B2 * 3/2015 Simmel ..... H01R 13/659 439/108
9,022,800 B2 * 5/2015 Yang ..... H01R 13/6581 439/487
2006/0019540 A1 * 1/2006 Werthman ..... G01K 1/14 439/488
2006/0040546 A1 * 2/2006 Werthman ..... H01R 13/7137 439/488
2006/0063419 A1 * 3/2006 Steinkemper ..... H01R 4/4827 439/441
2006/0063420 A1 * 3/2006 Reibke ..... H01R 4/4827 439/441
2008/0139056 A1 * 6/2008 Kumakura ..... H01R 43/16 439/866
2008/0188144 A1 * 8/2008 Myer ..... H01R 13/113 439/852
2010/0048065 A1 * 2/2010 MacKinnon ..... G01K 7/023 439/695
2010/0081346 A1 * 4/2010 Hoppe ..... H01R 4/4827 439/822
2011/0151716 A1 * 6/2011 Kondo ..... H01R 13/6658 439/607.01
2011/0230076 A1 * 9/2011 Lim ..... H01R 9/032 439/345
2011/0318975 A1 * 12/2011 Giefers ..... H01R 4/489 439/818
2012/0088415 A1 4/2012 Ramm
2012/0220173 A1 * 8/2012 Mizutani ..... H01R 13/113 439/752.5
2014/0057502 A1 * 2/2014 Takayama ..... H01R 4/203 439/877
2014/0206209 A1 * 7/2014 Kamei ..... H01R 24/60 439/81
2014/0374632 A1 * 12/2014 Pablo Curto ..... H01R 4/242 251/129.01
2015/0079825 A1 * 3/2015 Miyamoto ..... H01R 4/62 439/152
2015/0140876 A1 * 5/2015 Lehner ..... H01R 13/04 439/891
2015/0263456 A1 * 9/2015 Hashimoto ..... H01R 13/113 439/752.5
2015/0364871 A1 * 12/2015 Lin ..... H01R 13/6581 439/607.58
2016/0013592 A1 * 1/2016 Kao ..... H01R 13/6471 439/607.55
2016/0013599 A1 * 1/2016 Ueda ..... H01R 13/6596 439/607.01
2016/0134047 A1 * 5/2016 Nishikawa ..... H01R 43/28 439/589

FOREIGN PATENT DOCUMENTS

| | | | |
|---|---|---|---|
| JP | 996570 | A | 4/1997 |
| JP | 2007-149476 | A | 6/2007 |
| JP | 2015-50131 | A | 3/2015 |
| TW | M351535 | U | 2/2009 |
| WO | 2011151393 | A1 | 12/2011 |
| WO | 2013161551 | A1 | 10/2013 |

OTHER PUBLICATIONS

Machine translation of WO2013161551, dated Oct. 31, 2013, 14 pages.
European Search Report, dated Dec. 5, 2016, 8 pages.
Japanese Office Action, dated Feb. 26, 2019, 3 pages.
Abstract of JP 2007149476A, dated Jun. 14, 2007, 1 page.
Japanese Second Office Action, Japanese Patent Application No. 2015-154092, dated May 17, 2019, 2 pages.
Abstract of JP2015050131A, dated Mar. 16, 2015, 1 page.
Taiwanese Office Action, dated Jun. 19, 2019, 6 pages.

* cited by examiner

ELECTRICAL TERMINAL OF A THERMOCOUPLE

CROSS-REFERENCE TO RELATED APPLICATION

This application claims the benefit of the filing date under 35 U.S.C. § 119(a)-(d) of Japanese Patent Application No. 2015-154092 filed Aug. 4, 2015.

FIELD OF THE INVENTION

The present invention relates to an electrical terminal, and more particularly, to an electrical terminal of a thermocouple.

BACKGROUND

In a known thermocouple, a first end of each of two kinds of metal wires, for example, alumel and chromel, are connected to one another. The thermocouple measures the thermoelectromotive force occurring between two opposite second ends. Interposition of a different kind of metal, such as copper, between the second ends and a measuring device causes a measurement error. Known thermocouples thus use an alumel lead wire to connect the alumel wire to the measuring device, and a chromel lead wire to connect the chromel wire to the measuring device.

Some metals used for thermocouples, such as alumel, chromel, or constantan, have poor ductility, malleability, or elasticity, and are unsuitable in themselves as electrical terminal materials. Japanese Patent Application Laid-Open No. H09-96570 discloses an electrical terminal of a thermocouple in which the thermocouple is either screwed to a contact pin made of the same material or crimped to a crimp terminal made of the same material. However, a screw connection is time consuming to form and susceptible to loosening, and many materials used in thermocouples are too brittle to resist the deformation of crimping.

SUMMARY

An object of the invention, among others, is to provide an electrical terminal capable of directly connecting metal materials that are otherwise unsuitable as electrical terminal materials. The disclosed electrical terminal has a contact made of a first kind of metal and a coupling member made of a second kind of metal fixed to the contact. The coupling member has a crimping portion crimped to press the first contact against an electrical wire made of the first kind of metal.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of an electrical terminal. This invention may, however, be embodied in many different forms and should not be construed as limited to the embodiments set forth herein; rather, these embodiments are provided so that this disclosure will be thorough and complete and still fully convey the scope of the invention to those skilled in the art.

An electrical terminal 10A according to the invention is shown generally in FIGS. 1-5. The electrical terminal 10A has a contact 20 and a coupling member 30. The major components of the invention will now be described in greater detail.

Figure 1:
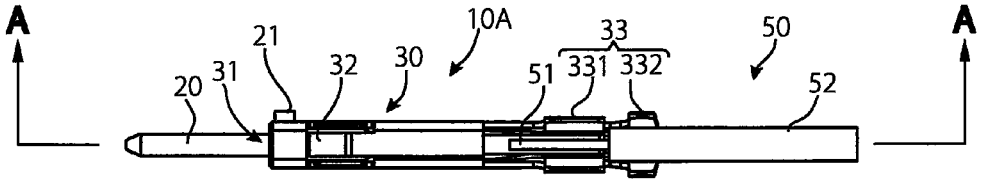
FIG. 1 is a top view of an electrical terminal according to the invention.
Figure 2:
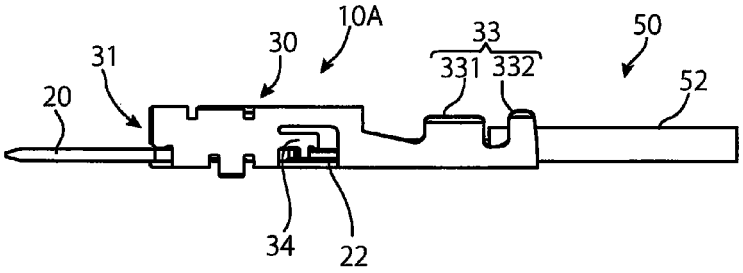
FIG. 2 is a right side view of the electrical terminal of FIG. 1.
Figure 3:
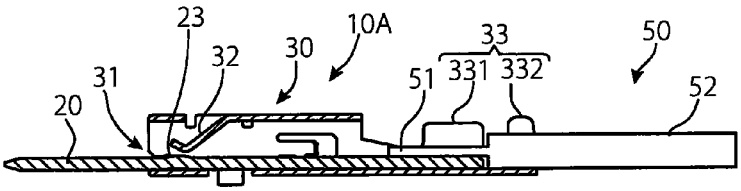
FIG. 3 is a sectional view taken along arrow A-A shown in FIG. 1.

The contact 20, as shown in FIGS. 1-3, has an elongated shape tapered at a first end. In the shown embodiment, the contact 20 has an elongated rectangular shape, but the contact 20 could alternatively have a circular, rod-like shape.

The contact 20 is made of the same metal material as the material of the wire is it used to connect, for example, a contact 20 for an alumel thermocouple wire is made of alumel, and a contact for a chromel thermocouple wire is made of chromel. The contacts 20 are described herein as formed from alumel or chromel. However, metal materials constituting a thermocouple are not limited to alumel and chromel. The contacts 20 may alternatively be formed of a different metal material such as constantan, nicrosil, nisil, iron, platinum, platinum-rhodium alloy, iridium, iridium-rhodium alloy, tungsten-rhenium alloy, nichrome, gold-iron alloy, nickel, nickel-molybdenum alloy, palladium-platinum-gold alloy, gold-palladium alloy, gold-cobalt alloy, or similar thermocouple metals known to those with ordinary skill in the art.

The contact 20 has a projection 21, a catch 22, and a contact point 23.

As shown in FIG. 1, the projection 21 projects from one side face of the contact 20. The particular side from which the projection 21 projects indicates the type of material of the contact 20; if the projection 21 is positioned on the left side when the electrical terminal 10A shown is viewed from the front, the contact 20 of the electrical terminal 10A is either alumel and chromel, and if the projection 21 is positioned on the right side, the contact 20 of the electrical terminal 10A is the other of alumel and chromel. The projection 21 further functions as a key preventing false insertion when the electrical terminal 10A is inserted into a housing (not shown).

Figure 4:
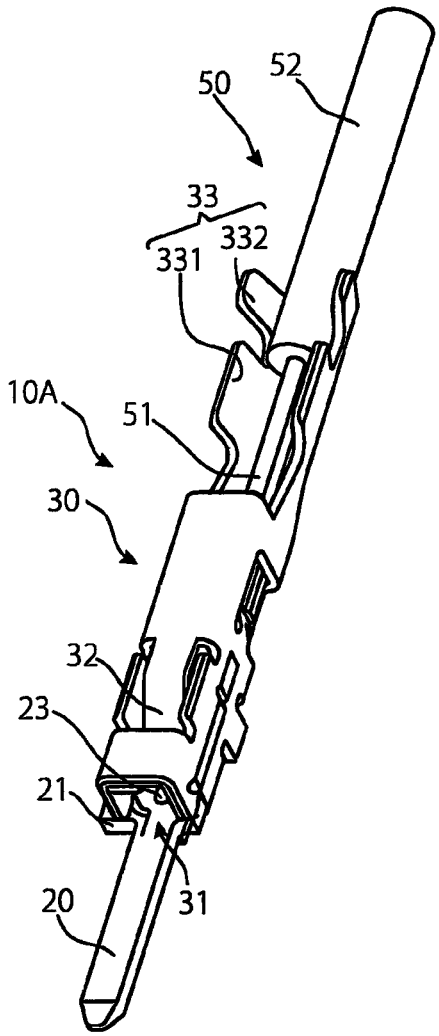
FIG. 4 is an isometric view of the electrical terminal of FIG. 1 in a pre-crimped position.

The catch 22, shown in FIG. 2, is disposed approximately centrally on a side of the contact 20. The contact point 23, shown in FIGS. 3 and 4, is embossed from the bottom face side of contact 20 so as to project upward.

The coupling member 30, as shown in FIGS. 1-3, has a substantially-rectangular sectional shape. In the shown embodiment, the coupling member 30 is made of a copper alloy, but one with ordinary skill in the art would understand that the coupling member 30 could be made of other conductive materials. The coupling member 30 has an insertion opening 31, a spring 32, a crimping portion 33, and a latch 34.

The insertion opening 31 extends into a front end of the coupling member 30.

The spring 32 is formed in a cantilever-like shape, a rear end thereof is a fixed end and a front end thereof is a free end. The fixed end of the spring 32, as shown in FIG. 3, is attached to a top wall of the coupling member 30, and the free end of the spring 32 extends into an interior of the coupling member 30 adjacent the insertion opening 31.

The crimping portion 33 has a core crimping portion 331 and a sheath crimping portion 332. The sheath crimping portion 332 is disposed on a rear end of the coupling member 30 and the core crimping portion 331 is disposed along a length of the coupling member 30 toward a center of the coupling member 30, adjacent the sheath crimping portion 332. Both the core crimping portion 331 and the sheath crimping portion 332 have an open-top, substantially-U sectional shape.

The latch 34, as shown in FIG. 2, is disposed approximately centrally along a side of the coupling member 30.

The assembly of the electrical terminal 10A will now be described with reference to FIGS. 1-4.

The contact 20 extends into the insertion opening 31. A rear end portion of the contact 20 extends to the core crimping portion 331, as shown in FIG. 3, and a front end portion of the contact 20 extends outward from the insertion opening 31. In the shown embodiment, the coupling member 30 is fixed to the contact 20 by spot welding. The coupling member 30 is alternatively fixed to the contact 20 by swaging, or could be fixed to the contact 20 by other types of fixed attachments known to those with ordinary skill in the art.

The latch 34 engages with the catch 22, thereby preventing the contact 20 from forwardly disconnecting from the coupling member 30. The spring 32 extends frontward and rearward along the contact 20, with the free end of the spring 32 extending toward the contact 20.

The use of the electrical terminal 10A will now be described with reference to FIGS. 1-5. In FIGS. 1-5, a compensating lead wire 50 is shown in addition to the electrical terminal 10A.

The electrical terminal 10A electrically connects a thermocouple (not shown) and a measuring device (not shown). The thermocouple uses two kinds of metal electrical wires, for example, alumel and chromel. The wires constituting the thermocouple are connected to a compensating lead wire 50 formed of the same material via the electrical terminal 10A having a structure shown herein, and led to the measuring device (not shown) by the compensating lead wire 50.

The compensating lead wire 50 is inserted into the electrical terminal 10A in a pre-crimped position shown in FIGS. 1-4. The compensating lead wire 50 has a core 51 and a sheath 52 covering the core 51. The core 51 is made of alumel or chromel. The compensating lead wire 50 having the alumel core 51 is crimped and fixed to the electrical terminal 10A having the alumel contact 20. Similarly, the compensating lead wire 50 having the chromel core 51 is crimped and fixed to the electrical terminal 10A having the chromel contact 20.

Figure 5:
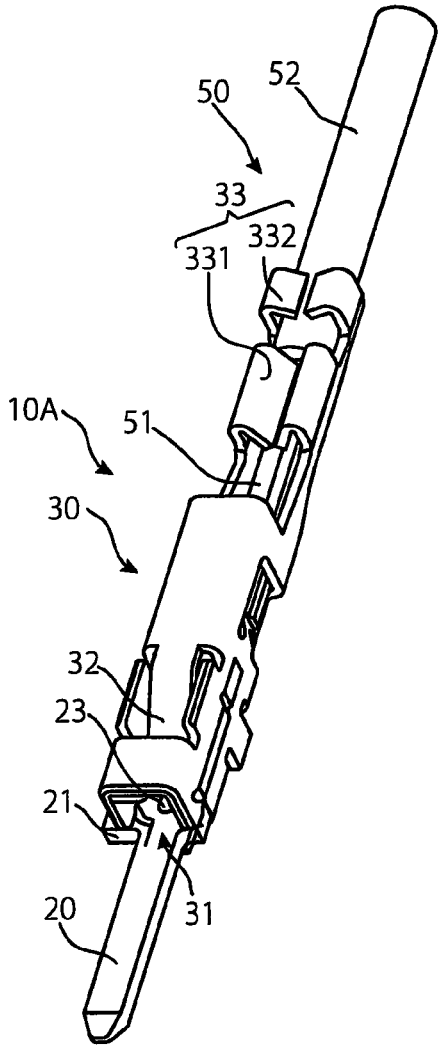
FIG. 5 is an isometric view of the electrical terminal of FIG. 1 crimped to a compensating lead wire.

As shown in FIGS. 4 and 5, the compensating lead wire 50 is crimped and fixed to the electrical terminal 10A by the crimping portion 33.

The core 51 is stripped by removing the sheath 52 at a distal end portion of the compensating lead wire 50. Then, the stripped core 51 is disposed in the core crimping portion 331 as shown in FIG. 4. The core 51 comes into direct contact with the contact 20 in the core crimping portion 331, as best shown in FIG. 3.

When the stripped core 51 is placed in the core crimping portion 331, a portion of the compensating lead wire 50 therebehind where the core 51 is covered with the sheath 52 is disposed in the sheath crimping portion 332. Since the contact 20 extends to the core crimping portion 331, but not to the sheath crimping portion 332, the core 51 is placed in a higher position than a lower face of the sheath 52 by the thickness of the contact 20, as shown in FIG. 3. The thickness of the contact 20 is adjusted so that the core 51 is located at a center of a cross-section of the compensating lead wire 50 even after crimping.

The crimping portion 33 is then crimped, as shown in FIG. 5, with the core crimping portion 331 crimped to the core 51 and the sheath crimping portion 332 crimped to the sheath 52. In the core crimping portion 331, the core 51 is directly pressed against and electrically connected to the contact 20. In the sheath crimping portion 332, the compensating lead wire 50 is firmly fixed to the electrical terminal 10A. Thus, even if unintentional force is applied to the compensating lead wire 50 in the crimped state, the force is not transmitted to the core 51 within the core crimping portion 331, since the compensating lead wire 50 is crimped and fixed in the sheath crimping portion 332. Connection between the core 51 and the contact 20 formed of the same metal material is stably maintained.

The electrical terminal 10A crimped to the compensating lead wire 50 mates with a mating electrical terminal (not shown). The mating electrical terminal is formed identically to the electrical terminal 10A such that the mating electrical terminal has a mating contact and a mating coupling member having a mating spring and a mating crimping portion crimped to a wire such as an alumel or chromel wire. The alumel wire and the chromel wire constituting the thermocouple both have the same structures and the same dimensions as the compensating lead wire 50 shown in FIGS. 1-5. Therefore, the alumel wire and the chromel wire constituting the thermocouple and the compensating lead wire 50 connecting the thermocouple and the measuring device may be both referred to as compensating lead wire 50 without discrimination. Further, the mating electrical terminal is crimped to the alumel or chromel wire just as the electrical terminal 10A is crimped to the compensating lead wire 50.

The mating contact and wire formed of the mating electrical terminal are formed of the same material as the contact 20 and compensating lead wire 50 of the electrical terminal 10A to which it mates. When the contact 20 and compensating lead wire 50 of the electrical terminal 10A is made, for example, of alumel, the mating electrical terminal has a mating contact and a wire made of alumel. Similarly, when the contact 20 and compensating lead wire 50 of the electrical terminal 10A is made of chromel, the mating contact and wire of the mating electrical terminal is also made of chromel.

In mating the electrical terminal 10A and the mating electrical terminal with each other, the mating electrical terminal is turned upside down with respect to the electrical terminal 10A, and the mating contact of the mating electrical terminal is inserted through the insertion opening 31 of the electrical terminal 10A. The mating contact of the mating electrical terminal is held between the contact 20 and the spring 32. The spring 32, by virtue of being formed from a copper alloy, is elastic and presses the mating contact against the contact 20 with a predetermined contact pressure. The contact 20 of the electrical terminal 10A is also pressed against the mating contact by a mating spring of the mating electrical terminal. In this manner, an alumel or chromel wire is electrically connected to an alumel or chromel compensating lead wire 50 by a respective alumel or chromel mating contact and a respective alumel or chromel contact 20. The alumel or chromel wire is thus electrically connected to the alumel or chromel compensating lead wire 50 without interposition of a different metal material.

Figure 6:
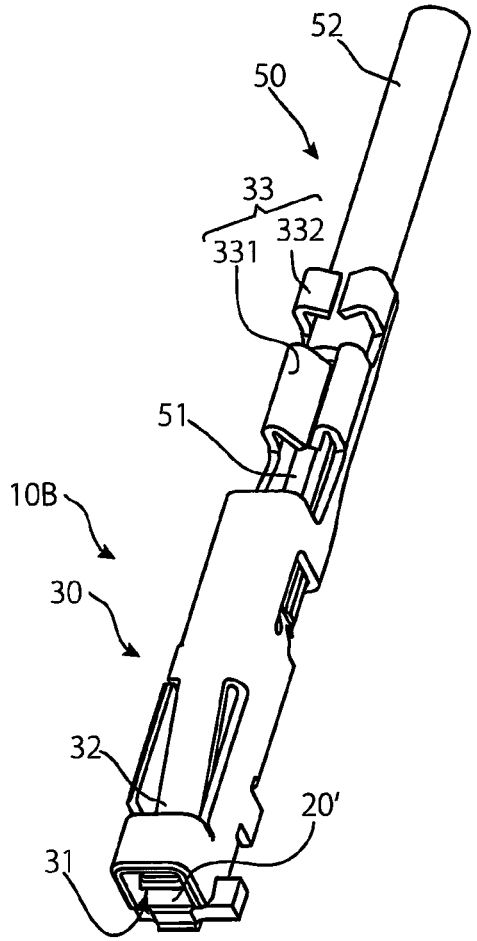
FIG. 6 is an isometric view of an electrical terminal according to another embodiment of the invention.

An electrical terminal 10B according to another embodiment of the invention is shown in FIG. 6. Like reference numbers indicate like components with respect to the electrical terminal 10A shown in FIGS. 1-5, and only differences will be described herein. In the electrical terminal 10A, the contact 20 projects frontward beyond the insertion opening 31. In contrast, in the electrical terminal 10B shown in FIG. 6, a contact 20' thereof extends only to a position aligned with the front end of the coupling member 30. In the case of the electrical terminal 10B, the contact 20' does not extend into a mating electrical terminal. The electrical terminal 10B receives the mating contact, which is pressed against the contact 20' of the electrical terminal 10B by the spring 32 of the electrical terminal 10B, and the contacts are thus connected together.

Figure 7:
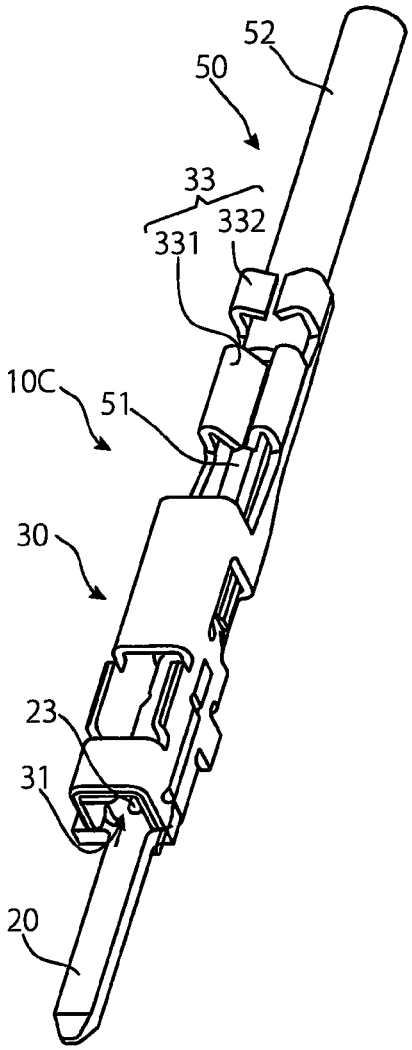
FIG. 7 is an isometric view of a mating electrical terminal mating with the electrical terminal of FIG. 6.

An electrical terminal 10C according to another embodiment of the invention is shown in FIG. 7. Like reference numbers indicate like components with respect to the electrical terminal 10A shown in FIGS. 1-5, and only differences will be described herein. The electrical terminal 10C is used as a mating electrical terminal mating with the electrical terminal 10B shown in FIG. 6. The mating electrical terminal 10C, as compared with the electrical terminal 10A, has a shape obtained by removing the spring 32 from the coupling member 30 of the electrical terminal 10A, since the contact 20' of electrical terminal 10B does not extend into mating electrical terminal 10C.

Figure 8:
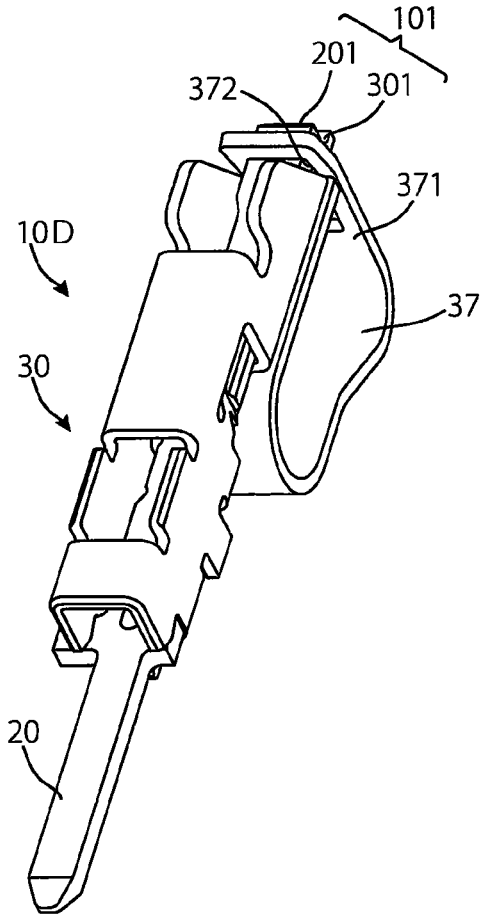
FIG. 8 is an isometric view of an electrical terminal according to another embodiment of the invention.
Figure 9:
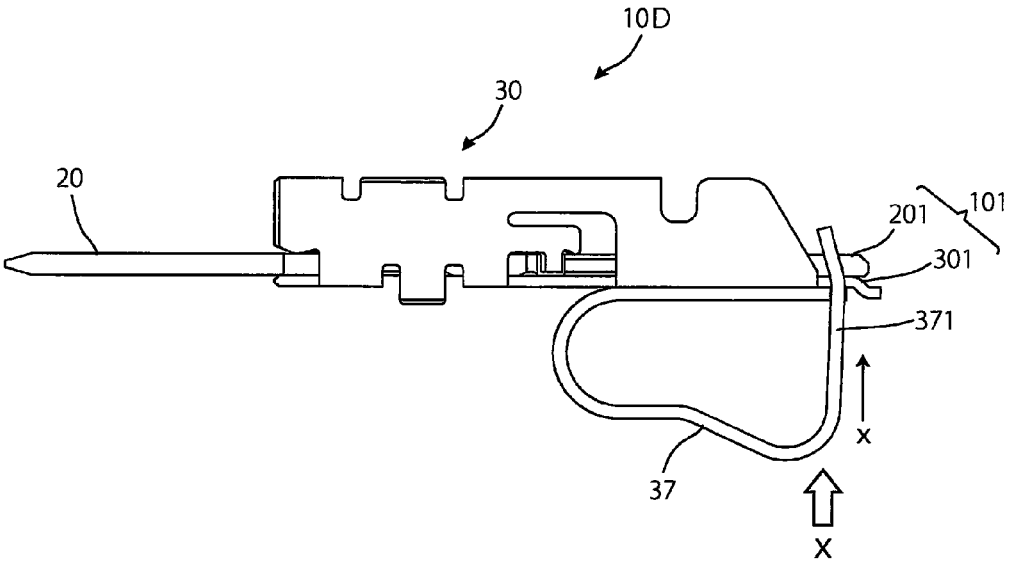
FIG. 9 is a right side view of the electrical terminal of FIG. 8.
Figure 10:
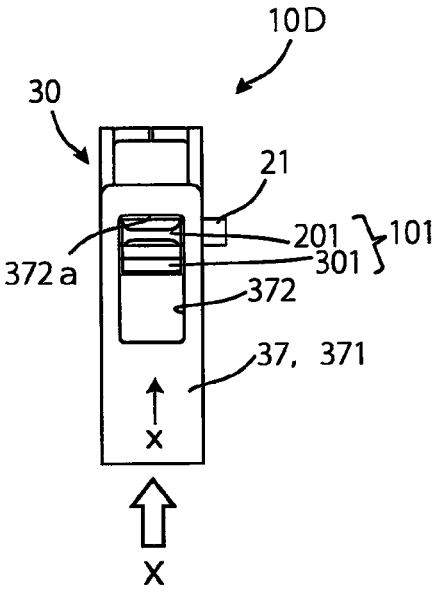
FIG. 10 is a rear view of the electrical terminal of FIG. 8.

An electrical terminal 10D according to another embodiment of the invention is shown in FIGS. 8-10. Like reference numbers indicate like components with respect to the electrical terminal 10A shown in FIGS. 1-5, and only differences will be described herein.

In the electrical terminal 10A, the coupling member 30 is provided with the crimping portion 33 for connecting the compensating lead wire 50. In contrast, an electrical terminal 10D shown in FIGS. 8-10 has a spring clamp 37 in place of the crimping portion 33. A rear wall portion 371 of the spring clamp 37 is provided with a slot 372. In the slot 372, a rear end portion 101 of the electrical terminal 10D, which is composed of a rear end portion 201 of the contact 20 and a rear end portion 301 of a portion of the coupling member 30 serving as a base of the contact 20, is inserted.

The rear end portion 101 is inserted into the slot 372 while the spring clamp 37 is being elastically deflected in a direction of arrow x shown in FIGS. 9 and 10. The elastic deflection of the spring clamp 37 urges the rear wall portion 371 in a direction counter to the arrow x, thereby causing an upper end edge 372*a* of the slot 372 to abut on the rear end portion 101.

To connect the compensating lead wire 50 to the electrical terminal 10D, force is applied to the spring clamp 37 in the direction of arrow x, deflecting the rear wall portion 371 in the direction of arrow x. A clearance is formed between the upper end edge 372*a* and the rear end portion 201 of the contact 20, as shown in FIG. 10. The stripped core 51 of the compensating lead wire 50 is inserted into the clearance, and the spring clamp 37 is then released from the force in the direction of arrow x. The rear wall portion 371 of the spring clamp 37 moves in a direction counter to the direction of arrow x, and the core 51 is held between the upper end edge 372*a* of the slot 372 and the rear end portion 201 of the contact 20. Therefore, the core 51 is pressed by the upper end edge 372*a* of the slot 372 and comes in contact with the rear end portion 201 of the contact 20 with a predetermined contact pressure, so that reliable conduction between the core 51 and the contact 20 is secured. The force of the upper end edge 372*a* pressing the core 51 against the rear end portion 201 is dictated by the spring strength of the spring clamp 37.

The electrical terminal 10D in the shown embodiment does not have a spring 32. The electrical terminal 10D is coupled with a mating electrical terminal provided with the spring 32, for example, the electrical terminal 10B, to provide a contact force between the contacts 20. The electrical terminal 10D could alternatively be provided with a spring 32 such that the electrical terminal 10D could mate with an identical electrical terminal 10D.

An electrical terminal 10A-10D for a thermocouple has been described by way of example, however, a scope of application of the present invention is not limited to a thermocouple. For example, many contacts are made from pure copper in order to flow a high current. Pure copper, however, is so soft that it cannot constitute an electrical terminal by itself. Consequently, an electrical terminal 10A-10D may alternatively be used to adapt an electrical connection of a contact made of pure copper.

Advantageously, according to the electrical terminals 10A-10D of the present invention, even metal materials unsuitable as electrical terminal materials can be directly and reliably connected together. The present invention is thus widely applicable when electrical signal transmission or power transmission is required to be performed using a metal material which cannot form an electrical terminal by itself. Specifically, when the electrical terminal 10A is used with an identical mating electrical terminal, an alumel wire or a chromel wire of a thermocouple can be extended to a measuring device via the electrical terminal 10A using an electrical wire made of the same material without interposition of a different metal. The material for the core 51, which is alumel, chromel, or the like, is brittle and not a material appropriate for crimping. The coupling member 30 of electrical terminals 10A-10D, however, is made of a suitable crimping material, and can reliably fix and electrically connect the brittle core 51 to the contact 20.

What is claimed is:

1. An electrical terminal, comprising:

a contact made of a first metal having a projection extending from one side of the contact; and a coupling member made of a second metal different than the first metal, the coupling member having a crimping portion crimped to press the contact against an electrical wire made of the first metal, the coupling member being fixed to a rear end of the contact independently of crimping at the crimping portion and defining an insertion opening, wherein a front end of the contact extends from the insertion opening and the projection extends from the contact at a position adjacent the insertion opening.

2. The electrical terminal of claim 1, wherein the coupling member is fixed to the contact by spot welding or swaging.

3. The electrical terminal of claim 1, wherein the contact has an elongated rectangular shape or a rod-like shape.

4. An electrical terminal comprising:

a contact made of a first metal having a projection extending from one side of the contact and a catch disposed approximately centrally on a side of the contact; and a coupling member made of a second metal different than the first metal and fixed to a rear end of the contact, the coupling member configured hold an electrical wire made of the first metal in electrical contact with the contact, the coupling member including:

a latch disposed approximately centrally on a side of the coupling member and engaging the catch;

an insertion opening, wherein the projection extends from the contact at a position adjacent the insertion opening; and a crimping portion crimped to press the contact against an electrical wire made of the first metal.

5. The electrical terminal of claim 1, wherein the coupling member has a spring formed as a cantilever.

6. The electrical terminal of claim 5, wherein the spring extends along the contact and has a free end extending toward the contact and into the insertion opening.

7. The electrical terminal of claim 6, wherein the coupling member has a sheath crimping portion disposed on a rear end of the coupling member and a core crimping portion disposed adjacent the sheath crimping portion.

8. The electrical terminal of claim 7, wherein the sheath crimping portion is crimped to a sheath of the electrical wire and the core crimping portion is crimped to a core of the electrical wire.

9. The electrical terminal of claim 3, wherein a front end of the contact is aligned with a front end of the coupling member.

10. An electrical terminal, comprising:

a contact made of a first metal having a projection extending from one side face of the contact; and a coupling member made of a second metal different than the first metal and fixed to a rear end of the contact, the coupling member having a spring clamp elastically pressing the contact against an electrical wire made of the first metal, the spring clamp being biased into a pressing position via an elastic force and being selectively biasable from the pressing position to an open position by a user.

11. The electrical terminal of claim 10, wherein the coupling member is fixed to the rear end of the contact independently of the spring clamp.

12. The electrical terminal of claim 1, wherein the first metal is£! type of metal used in a thermocouple.

13. The electrical terminal of claim 12, wherein the second metal is a copper alloy.

14. The electrical terminal of claim 10, wherein the first metal is a type of metal used in a thermocouple.

15. The electrical terminal of claim 14, wherein the second metal is a copper alloy.

16. The electrical terminal of claim 1, wherein the second metal is a type of metal that is not used in a thermocouple.

17. The electrical terminal of claim 1, wherein a particular side from which the projection projects indicates the type of material of the first metal.

18. The electrical terminal of claim 1, wherein the projection is a key preventing incorrect insertion when the electrical terminal is inserted into a mating housing.

19. The electrical terminal of claim 10, wherein a particular side from which the projection projects indicates the type of material of the first metal.

20. The electrical terminal of claim 10, wherein the projection is a key preventing incorrect insertion when the electrical terminal is inserted into a mating housing.

21. The electrical terminal of claim 10, wherein:

the contact includes a catch disposed approximately centrally on a side of the contact; and the coupling member includes a latch disposed approximately centrally on a side of the coupling member engaging the catch.

22. The electrical terminal of claim 10, wherein the coupling member further defines an insertion opening, and the projection extends from the contact at a position adjacent to the insertion opening.

* * * * *